US006756011B2

(12) United States Patent
Koga et al.

(10) Patent No.: US 6,756,011 B2
(45) Date of Patent: Jun. 29, 2004

(54) HIGH-STRENGTH, HIGH CORROSION-RESISTANT AND NON-MAGNETIC STAINLESS STEEL

(75) Inventors: Takeshi Koga, Nagoya (JP); Tetsuya Shimizu, Nagoya (JP); Toshiharu Noda, Nagoya (JP)

(73) Assignee: Daido Tokushuko Kabushiki Kaisha, Aichi (JP)

( * ) Notice: Subject to any disclaimer, the term of this patent is extended or adjusted under 35 U.S.C. 154(b) by 164 days.

(21) Appl. No.: 10/062,448

(22) Filed: Feb. 5, 2002

(65) Prior Publication Data

US 2002/0148537 A1 Oct. 17, 2002

(30) Foreign Application Priority Data

Feb. 5, 2001 (JP) ..... 2001-028196

(51) Int. Cl.[7] ..... C22C 38/20

(52) U.S. Cl. ..... 420/60; 420/61; 420/69; 420/70

(58) Field of Search ..... 420/60, 61, 69, 420/70, 56, 57, 58, 59, 67, 68

(56) References Cited

U.S. PATENT DOCUMENTS

| | | | | |
|---|---|---|---|---|
| 5,019,332 A | * | 5/1991 | Wegman et al. | 420/59 |
| 5,714,115 A | | 2/1998 | Speidel et al. | |

FOREIGN PATENT DOCUMENTS

| | | | |
|---|---|---|---|
| CH | 688 862 | A5 | 4/1998 |
| CH | 688 914 | A5 | 5/1998 |
| DE | 42 42 757 | C1 | 3/1994 |
| DE | 196 07 828 | A1 | 10/1996 |
| EP | 0 577 898 | A1 | 1/1994 |
| JP | 02-156046 | | 6/1990 |
| JP | 10-121203 | | 5/1998 |
| WO | 00/73528 | A1 | 12/2000 |
| WO | 01/00897 | A1 | 1/2001 |

* cited by examiner

*Primary Examiner*—Daniel Jenkins
(74) *Attorney, Agent, or Firm*—Bacon & Thomas, PLLC

(57) ABSTRACT

A high-strength, high corrosion-resistant and non-magnetic stainless steel which is further excellent in strength and corrosion resistance and safe in the living body and also can stand against various corrosive environments. The stainless steel comprises 0.15% by weight or less of C, 1.0% or less of Si, 3.0 to 12.0% of Mn, 0.030% or less of P, 0.50% or less of Ni, 15.0 to 21.0% of Cr, 0.70 to 1.50% of N, 0.020% or less of Al and 0.020% or less of O, and a remainder of Fe and inevitable impurities.

5 Claims, No Drawings

HIGH-STRENGTH, HIGH CORROSION-RESISTANT AND NON-MAGNETIC STAINLESS STEEL

FIELD OF THE INVENTION

This invention relates to a high-strength, high corrosion-resistant and non-magnetic stainless steel, particularly to a high Mn and high N high-strength, high corrosion-resistant and non-magnetic stainless steel.

BACKGROUND OF THE INVENTION

Up to now, austenitic stainless steels such as Ni-containing SUS 304 (contains 0.08% or less of C, 1.00% or less of Si, 2.00% or less of Mn, 0.045% or less of P, 0.030% or less of S, 8.00 to 10.50% of Ni and 18.00 to 20.00% of Cr, and the remainder of Fe and inevitable impurities) and SUS 316 (contains 0.08% or less of C, 1.00% or less of Si, 2.00% or less of Mn, 0.045% or less of P, 0.030% or less of S, 10.00 to 14.00% of Ni, 16.00 to 18.00% of Cr and 2.00 to 3.00% of Mo, and the remainder of Fe and inevitable impurities) have been frequently used as materials for ornaments including necklaces, pierces and rings and for watchcases and watchbands.

Also, a Ni-containing austenitic stainless steel such as the SUS 316 or an SUS 316L (contains 0.03% or less of C, 1.00% or less of Si, 2.00% or less of Mn, 0.045% or less of P, 0.030% or less of S, 12.00 to 15.00% of Ni, 16.00 to 18.00% of Cr and 2.00 to 3.00% of Mo, and the remainder of Fe and inevitable impurities) has been frequently used in parts to be used in the living body, including dental materials and implant materials.

However, a problem is becoming serious mainly in Europe that these Ni-containing materials cause allergy due to Ni released into the living body.

In order to solve this problem, a so-called Ni-free stainless steel which does not contain Ni has been developed and its practical use is being attempted in Europe, by substituting Mn and N for Ni by pressurized ESR method.

However, though this Ni-free stainless steel has a high pitting resistance equivalent (Cr+3.3 Mo+16 N) which is frequently used as an index for corrosion resistance, it has a disadvantage in that its corrosion resistance is inferior to a Ni-containing stainless steel having the same equivalent.

Also, a low Ni stainless steel for biomaterial, which comprises 0.06% or less of C, 1.0% or less of Si, 15.0 to 22.0% of Mn, 0.030% or less of P, 0.015% or less of S, 1.0% or less of Ni, 15.0 to 18.0% of Cr, 0.5 to 4.0% of Mo, 0. 35 to 0.60% of N and 0.020% or less of 0, and further comprises, if required, one or two or more of 0.1 to 1.5% of Cu, 0.1 to 0.8% of W, 0.01 to 0.25% for each of Nb, V, Ti, Ta and Hf, Ca, Mg, B and REM as 0.0005 to 0.010% of Ca, 0.0005 to 0.010% of Mg, 0.0005 to 0.010% of B and 0.0005 to 0.010% of REM and 0.005 to 0.15% for each of Pt, Au, Ag and Pd, and the remainder of Fe and inevitable impurities, as an alloy which does not contain Ni, is described in Japanese Patent Application Laid-Open No. 10-121203.

However, though this alloy has no problem as a biomaterial use because of the low Ni, its corrosion resistance is not sufficient.

SUMMARY OF THE INVENTION

The object of the invention is to provide a high-strength, high corrosion-resistant and non-magnetic stainless steel which is further excellent in corrosion resistance and excellent for biomaterial body and also can stand against various corrosive environments.

In order to achieve this object, the present inventors have conducted intensive studies on a high-strength, high corrosion-resistant and non-magnetic stainless steel which does not contain Ni, is further excellent in corrosion resistance and biomateiral and also can stand against various corrosive environments, and found as a result that Mn contained in a large amount as a substitute element for Ni and to secure solubility of N deteriorates corrosion resistance and the corrosion resistance is improved by increasing the N content in a more larger amount by its pressurized melting and simultaneously decreasing the Mn content.

The invention has been accomplished based on these knowledge.

That is, according to the high-strength, high corrosion-resistant and non-magnetic stainless steel of the invention, it contains 0.15% or less of C, 1.0% or less of Si, 3.0 to 12.0% of Mn, 0.030% or less of P, 0.50% or less of Ni, 15.0 to 21.0% of Cr, 0.70 to 1.50% of N, 0.020% or less of Al and 0.020% or less of 0, and the rest substantially comprises Fe (the phrase "the rest substantially comprises Fe" as used in this specification means the remainder of Fe and inevitable impurities).

Also, according to the high-strength, high corrosion-resistant and non-magnetic stainless steel of the invention, it contains 0.15% or less of C, 1.0% or less of Si, 3.0 to 12.0% of Mn, 0.030% or less of P, 0.50% or less of Ni, 15.0 to 21.0% of Cr, 0.70 to 1.50% of N, 0.020% or less of Al and 0.020% or less of 0, and further contains one or two or more of 0.1 to 4.0% of Mo, 0.1 to 1.5% of Cu, 0.1 to 0.8% of W, 0.01 to 0.25% for each of Nb, V, Ti, Ta and Hf, 0.0005 to 0.0100% for each of Ca, Mg, B and REM, 0.03 to 0.4% of S, 0.005 to 0.05% of Te, 0.02 to 0.20% of Se and 0.0002 to 0.02% of Ca (excluding a case in which Ca is contained for the purpose of improving hot workability), and the rest substantially comprises Fe (i.e., the remainder of Fe and inevitable impurities).

DETAILED DESCRIPTION OF THE INVENTION

Next, the reason for the components of the high-strength, high corrosion-resistant and non-magnetic stainless steel of the invention and their amounts to be contained is described. However, the present invention should not be construed as being limited thereto.

Unless otherwise indicated, the "%" as used herein means "% by weight" based on the total weight of the stainless steel.

C: 0.15% or less

Though C is effective in improving strength and controlling blow holes of ingot as an austenite forming element, when it is included in an amount of 0.15%, preferably exceeding 0.10%, solubility of N in molten metal may be reduced and corrosion resistance may be deteriorated by reducing dissolved Cr content in the matrix, so that the content is preferably controlled to 0.15% or less. The content is preferably 0.10% or less.

Si: 1.0% or less

Si is an element which is added as a deoxidizing agent at the time of steel production, but hot workability may be reduced when it becomes 1.0% or more, so that the content is preferably controlled to 1.0% or less.

Mn: 3.0 to 12.0%

Since Mn has an action to increase dissolved amount of N in the molted metal, this is contained as an element for this purpose. It is necessary to contain 3.0% or more, preferably 4.0% or more of Mn for containing 0.70% or more of N, but corrosion resistance may be deteriorated when it is contained in an amount of 12.0%, preferably larger than 11.3%, so that the content is preferably controlled to 3.0 to 12.0%. The content is preferably from 4.0 to 11.3%, more preferably from 7.5 to 10.5%.

P: 0.030% or less

P is effective for improving corrosion resistance in some cases but it may reduce toughness by segregating on the grain boundary so that a smaller amount is desirable, but the content is preferably controlled to 0.030% or less because of the increase in cost when it is unnecessarily reduced.

S: 0.015% or less, or 0.03 to 0.40%

Since S may deteriorate hot workability and also deteriorate corrosion resistance by converting into MnS, it is adjusted to 0.015% or less, preferably 0.004% or less, when high machinability is not required. However, when a product having excellent machinability is required, this element is contained in an amount of 0.03% or more but 0.40% or less, because too many amount may cause deterioration of hot workability, toughness, and corrosion resistance.

Ni: 0.50% or less

Since Ni is an element which causes Ni allergy, a smaller amount is desirable but an unnecessarily reduced amount leads to the increase in cost, so that the content is preferably controlled to 0.50% or less. Preferred content is 0.1% or less.

Cr: 15.0 to 21.0%

Since Cr may increase dissolved amount of N in the molten metal and also improve corrosion resistance, this is contained as an element for these purposes. These effects may not be sufficient when the content is 15.0%, preferably 17.0% or less, and when the content is 21.0%, preferably larger than 20%, it may reduce dissolved N content, considerably deteriorates productivity due to generation of blow holes at the time of aggregation and causes inability to maintain non-magnetic property due to unstable austenite phase, so that the content is preferably controlled to 15.0 to 21.0%. The content is preferably from 17.0 to 20.0%, more preferably from 17.5 to 19.0%.

N: 0.70 to 1.50%

Since N stabilizes the austenite and improves strength and corrosion resistance, this is contained as an element for these purposes. When the content is 0.70%, preferably less than 0.81%, non-magnetic property may not be obtained easily and sufficient corrosion resistance may not be obtained, and when the content is 1.50%, preferably larger than 1.25%, dissolving temperature of nitrides may become high which exerts bad influences upon corrosion resistance and mechanical properties due to a large amount of remaining un-dissolved nitrides even under solution heat treatment condition, so that the content is preferably controlled to 0.70 to 1.50%. The content is preferably from 0.81 to 1.25%, more preferably from 0.95 to 1.10%.

Al: 0.020% or less

Al is a deoxidizing agent and effective in reducing O which deteriorates corrosion resistance, but it may reduce corrosion resistance when its amount becomes 0.020% or more due to increased amounts of oxides and nitrides, so that the content is preferably controlled to 0.020% or less.

O: 0.020% or less

Since O reduces the index of cleanliness of steel and reduces corrosion resistance, the content is preferably controlled to 0.020%. In this connection, it is desirable to adjust the content to 0.010% or less when an ultra-thin wire processing is carried out or corrosion resistance is more important.

Mo: 0.1 to 4.0%

Since Mo increases dissolved amount of N and improves corrosion resistance, this is contained as an element for these purposes. The effect to improve corrosion resistance may not be sufficient when the content is 0.1%, preferably less than 0.51%, and when the content is 4.0%, preferably larger than 3.0%, it may become difficult to secure the austenite which is effective in inhibiting blow holes at the time of aggregation and the productivity is considerably worsened due to formation of brittle phase, so that the content is preferably controlled to 0.1 to 4.0%. The content is preferably from 0.1 to 3.0%, more preferably from 0.51 to 2.5%.

Cu: 0.1 to 1.5%

Since Cu is effective in improving corrosion resistance, this is contained as an element for this purpose. It is necessary to contain this element in an amount of 0.1% or more, preferably 0.7% or more, to obtain excellent corrosion resistance, but the hot workability may be deteriorated when the amount is 1.5%, preferably larger than 1.35%, so that the content is preferably controlled to 0.1 to 1.5%. The content is preferably from 0.7 to 1.35%.

W: 0.1 to 0.8%

Since W is effective in improving corrosion resistance, this is contained as an element for this purpose. It is necessary to contain this element in an amount of 0.1% or more, preferably 0.3% or more, to obtain excellent corrosion resistance, but the hot workability may be deteriorated when the amount is 0.8%, preferably larger than 0.7%, so that the content is preferably controlled to 0.1 to 0.8%. The content is preferably from 0.3 to 0.7%.

Nb, V, Ti, Ta and Hf: 0.010 to 0.25%

Since Nb, V, Ti, Ta and Hf refine crystal grains and improve strength by the refining and also improve strength by solution treatment of the elements themselves, these elements are contained as elements for these purposes. It is necessary to contain each of these elements in an amount of 0.010% or more for obtaining these actions and effects, but when the amount of each element is 0.25%, preferably larger than 0.16%, bulky nitrides may be formed and may deteriorate corrosion resistance and fatigue strength, so that the content of each element is preferably controlled to 0.010 to 0.25%. The content is preferably from 0.010 to 0.16% for each.

Ca, Mg, B and REM (rare earth metals): 0.0005 to 0.0100%

Since Ca, Mg, B and REM improve hot workability, they are contained as elements for this purpose. It is necessary to contain each of these elements in an amount of 0.0005% or more for obtaining this effect, but when the amount of each of Ca, Mg and REM is larger than 0.0100%, the index of cleanliness of steel may be reduced to exert bad influences upon toughness and corrosion resistance and when the amount of B is larger than 0.0100%, it may form borides to exert bad influences upon hot workability and corrosion resistance, so that the content of each element is preferably controlled to 0.0005 to 0.0100%. Also, since Ca is an element which improves machinability, it is contained in an amount of from 0.0002 to 0.02% when used for this purpose.

Te: 0.005 to 0.05%

Since Te improves machinability, this is contained as an element for this purpose. It is necessary to contain it in an amount of 0.005% or more for obtaining this effect, but toughness and hot workability may be reduced when it exceeds 0.05%, so that the content is preferably controlled to 0.005 to 0.05%.

Se: 0.02 to 0.20%

Since Se improves machinability, this is contained as an element for this purpose. It is necessary to contain it in an amount of 0.02% or more for obtaining this effect, but toughness may be reduced when it exceeds 0.20%, so that the content is preferably controlled to 0.02 to 0.20%.

In an example of the method for producing the high-strength, high corrosion-resistant and non-magnetic stainless steel of the invention, it is produced by melting a steel having the alloy composition in a melting furnace such as a high frequency induction furnace which can be pressurized to make it into ingots, billets or slabs, and making the casts such as ingots into a steel product having a necessary size by hot forging or hot rolling and then subjecting it to solution treatment in which the steel product is heated at 1,100 to 1,200° C. for 15 to 60 minutes and then water-cooled.

Examples of the use of the high-strength, high corrosion-resistant and non-magnetic stainless steel of the invention include applications which are used biometal body and require non-magnetic property, applications which require high strength and high corrosion resistance and applications which require high strength, high corrosion resistance and non-magnetic property, such as eyeglasses, ornaments, watch materials, implant parts for living body use, shafts, screws and wires.

Since the high-strength, high corrosion-resistant and non-magnetic stainless steel of the invention does not use Ni, it does not cause Ni allergy in the living body due to elution of Ni, and since the amount of N to be used instead of Ni is increased, it becomes high-strength and non-magnetic. Also, since the amount of Mn to be used instead of Ni is reduced to a level smaller than the conventional amount, it has excellent corrosion resistance.

EXAMPLES

A 50 kg portion of each of the steels shown in Table 1 was melted using a high frequency induction furnace capable of carrying out pressurization and then cast into an ingot of 50 kg. Test pieces of 6ϕ×110 mm length were cut out from the ingot to carry out Gleable test for the evaluation of hot workability, with the results shown in Table 2. Subsequently, the ingot was subjected to cogging to obtain a 20 mm round bar and a 30 mm square bar. Next, materials were collected from sound parts and subjected to solution treatment in which the materials were heated at 1,150° C. for 30 minutes and then water-cooled. Thereafter, test pieces were cut out from respective round bars to carry out hardness test and tensile test, magnetic permeability measurement, pitting potential measurement and Ni elution test using the following methods. Also, drill life test pieces were cut out from the square bars to carry out the test. The results are shown in Table 2.

TABLE 1-1

(wt %)

| No. | C | Si | Mn | P | S | Ni | Cr | N | Al | O | Cu | Mo | W | Nb, Ti, V, Ta, Hf | Ca, B, Mg, REM | Se, S, Te |
|---|---|---|---|---|---|---|---|---|---|---|---|---|---|---|---|---|
| Examples | | | | | | | | | | | | | | | | |
| 1 | 0.02 | 0.15 | 4.10 | 0.020 | 0.001 | 0.01 | 20.0 | 0.81 | 0.011 | 0.006 | | | | | | |
| 2 | 0.01 | 0.21 | 8.20 | 0.023 | 0.002 | 0.03 | 18.1 | 1.02 | 0.005 | 0.003 | | | | | | |
| 3 | 0.02 | 0.30 | 8.51 | 0.018 | 0.003 | 0.05 | 20.2 | 1.21 | 0.013 | 0.004 | | | | | | |
| 4 | 0.06 | 0.23 | 11.30 | 0.021 | 0.006 | 0.08 | 20.3 | 1.23 | 0.009 | 0.008 | | | | | | |
| 5 | 0.12 | 0.61 | 11.20 | 0.018 | 0.006 | 0.05 | 18.0 | 0.89 | 0.008 | 0.006 | | | | | | |
| 6 | 0.03 | 0.23 | 8.13 | 0.023 | 0.008 | 0.34 | 17.8 | 0.95 | 0.018 | 0.008 | | | | | | |
| 7 | 0.02 | 0.25 | 8.21 | 0.024 | 0.011 | 0.04 | 18.3 | 1.02 | 0.017 | 0.005 | 1.13 | 0.51 | | | | |
| 8 | 0.02 | 0.21 | 8.01 | 0.024 | 0.005 | 0.06 | 18.5 | 1.05 | 0.008 | 0.012 | | 2.12 | | | | |
| 9 | 0.03 | 0.31 | 8.31 | 0.015 | 0.006 | 0.12 | 18.4 | 0.99 | 0.006 | 0.008 | | 1.51 | 0.51 | | | |
| 10 | 0.02 | 0.32 | 8.31 | 0.003 | 0.006 | 0.06 | 18.3 | 0.98 | 0.006 | 0.009 | | 2.21 | | | Ca: 0.0030 | |
| 11 | 0.03 | 0.21 | 8.31 | 0.024 | 0.008 | 0.05 | 18.1 | 1.03 | 0.014 | 0.007 | | 2.10 | | | Ca: 0.0030, Mg: 0.0021 | |
| 12 | 0.03 | 0.24 | 8.21 | 0.025 | 0.007 | 0.06 | 17.9 | 0.97 | 0.018 | 0.006 | | 2.03 | | | Ca: 0.0030, B: 0.0024 | |
| 13 | 0.01 | 0.25 | 8.31 | 0.020 | 0.009 | 0.06 | 18.3 | 1.05 | 0.003 | 0.002 | | 2.10 | | | B: 0.0012, REM: 0.0041 | |
| 14 | 0.03 | 0.21 | 8.14 | 0.025 | 0.008 | 0.08 | 18.1 | 1.02 | 0.005 | 0.004 | | 1.98 | | Nb: 0.091 | | |
| 15 | 0.03 | 0.21 | 7.95 | 0.021 | 0.007 | 0.04 | 18.4 | 0.99 | 0.005 | 0.007 | | 1.97 | | Nb: 0.051, Ti: 0.062 | | |
| 16 | 0.03 | 0.18 | 8.00 | 0.020 | 0.008 | 0.06 | 18.0 | 1.03 | 0.012 | 0.006 | | 2.00 | | Nb: 0.023, V: 0.15 | | |
| 17 | 0.01 | 0.26 | 8.64 | 0.015 | 0.006 | 0.02 | 18.6 | 1.09 | 0.002 | 0.003 | | 2.12 | | Hf: 0.086, V: 0.08 | | |
| 18 | 0.02 | 0.71 | 10.12 | 0.020 | 0.006 | 0.02 | 18.1 | 0.98 | 0.005 | 0.005 | | | | Nb: 0.18 | | |
| 19 | 0.03 | 0.25 | 10.24 | 0.026 | 0.007 | 0.04 | 18.4 | 1.02 | 0.006 | 0.008 | | | | Ti: 0.08 | | |
| 20 | 0.06 | 0.34 | 9.89 | 0.020 | 0.005 | 0.06 | 18.2 | 1.03 | 0.007 | 0.006 | | | | V: 0.23 | | |

TABLE 1-2

(wt %)

| No. | C | Si | Mn | P | S | Ni | Cr | N | Al | O | Cu | Mo | W | Nb, Ti, V, Ta, Hf | Ca, B, Mg, REM | Se, S, Te |
|---|---|---|---|---|---|---|---|---|---|---|---|---|---|---|---|---|
| Examples | | | | | | | | | | | | | | | | |
| 21 | 0.08 | 0.50 | 10.32 | 0.021 | 0.001 | 0.005 | 18.3 | 1.09 | 0.002 | 0.008 | | | | Ta: 0.08 | | |
| 22 | 0.03 | 0.30 | 9.78 | 0.025 | 0.009 | 0.03 | 18.1 | 0.97 | 0.002 | 0.006 | | | | Hf: 0.067 | | |
| 23 | 0.01 | 0.25 | 8.02 | 0.016 | 0.007 | 0.02 | 18.2 | 0.98 | 0.012 | 0.007 | | 1.98 | | Nb: 0.053 | B: 0.0021 | |

TABLE 1-2-continued (wt %)

| No. | C | Si | Mn | P | S | Ni | Cr | N | Al | O | Cu | Mo | W | Nb, Ti, V, Ta, Hf | Ca, B, Mg, REM | Se, S, Te |
|---|---|---|---|---|---|---|---|---|---|---|---|---|---|---|---|---|
| 24 | 0.02 | 0.25 | 8.01 | 0.015 | 0.007 | 0.01 | 18.2 | 0.98 | 0.005 | 0.006 | | | | | Ca: 0.004 | |
| 25 | 0.01 | 0.31 | 8.21 | 0.021 | 0.006 | 0.03 | 18.3 | 0.94 | 0.006 | 0.008 | | | | | B: 0.0024 | |
| 26 | 0.03 | 0.28 | 8.15 | 0.023 | 0.007 | 0.02 | 18.4 | 0.98 | 0.009 | 0.004 | | | | | Mg: 0.0015 | |
| 27 | 0.04 | 0.29 | 7.87 | 0.024 | 0.008 | 0.04 | 17.8 | 0.94 | 0.002 | 0.009 | | | | | REM: 0.0014 | |
| 28 | 0.02 | 0.31 | 8.12 | 0.032 | | 0.02 | 18.2 | 0.89 | 0.006 | 0.005 | | | | | | S:0.15 |
| 29 | 0.03 | 0.24 | 8.21 | 0.021 | 0.005 | 0.03 | 18.3 | 0.96 | 0.002 | 0.002 | | | | | | Se:0.16 |
| 30 | 0.04 | 0.23 | 7.85 | 0.024 | | 0.04 | 17.8 | 0.92 | 0.003 | 0.003 | | | | | | S:0.10, Se:0.08, Te:0.05 |
| 31 | 0.03 | 0.24 | 8.21 | 0.023 | | 0.06 | 18.2 | 1.01 | 0.005 | 0.002 | | 1.79 | | | | S:0.16 |
| 32 | 0.02 | 0.24 | 10.21 | 0.025 | 0.005 | 0.04 | 18.3 | 1.03 | 0.002 | 0.005 | 0.98 | | | Ti: 0.09 | | Se:0.14 |
| 33 | 0.03 | 0.31 | 9.89 | 0.025 | | 0.06 | 18.1 | 1.05 | 0.003 | 0.006 | | 1.89 | | V: 0.19 | B: 0.0031 | S:0.15, Te:0.04 |
| 34 | 0.01 | 0.26 | 9.67 | 0.025 | | 0.01 | 18.2 | 1.03 | 0.004 | 0.007 | | | 0.50 | | Mg: 0.0021 | S:0.14 |
| 35 | 0.02 | 0.34 | 9.78 | 0.029 | 0.006 | 0.03 | 17.9 | 1.05 | 0.006 | 0.005 | | | | Ta: 0.07 | Ca: 0.0025 | |
| 36 | 0.02 | 0.28 | 10.12 | 0.013 | 0.008 | 0.05 | 18.2 | 0.98 | 0.008 | 0.006 | | | | Hf: 0.04 | | Se:0.13 |
| 37 | 0.02 | 0.31 | 10.15 | 0.024 | 0.002 | 0.03 | 18.2 | 0.95 | 0.007 | 0.002 | | | | Nb: 0.08 | B: 0.0021 | Se:0.15 Te:0.06 |
| Comparative Examples | | | | | | | | | | | | | | | | |
| 1 | 0.04 | 0.34 | 1.12 | 0.029 | 0.012 | 11.8 | 17.8 | 0.03 | 0.025 | 0.005 | | 2.34 | | | | |
| 2 | 0.04 | 0.88 | 18.66 | 0.031 | 0.015 | 0.14 | 18.2 | 0.92 | 0.030 | 0.001 | | 1.96 | | | | |
| 3 | 0.02 | 0.21 | 18.1 | 0.023 | 0.004 | <0.1 | 16.0 | 0.45 | | 0.005 | <0.1 | 2.0 | | | | |

Comparative Example 1; SUS 316

The Gleable test was carried out within the range of from 900 to 1,300° C. at intervals of 50° C. Test pieces in which a temperature range showing a percentage reduction of area of 40% or more based on the base steel was increased was evaluated as ○, and did not change as Δ and deteriorated as X.

The tensile test was carried out at ordinary temperature using JIS No. 4 test pieces, and 0.2% proof stress and tensile strength were measure.

The magnetic permeability measurement was carried out using a vibration sample type magnetometer.

The pitting potential measurement was carried out in accordance with JIS G 0577.

Regarding the Ni elution test, a test piece of 10 mm in diameter and 35 mm in length was soaked in a 0.5% NaCl+0.1% urea+0.1% lactic acid (pH 6.5) aqueous solution in accordance with the European Standard EN 1811, the amount of Ni in the test solution one week thereafter was analyzed by ICP, and the result was converted to the eluted amount of Ni per 1 $cm^2$ of the sample surface.

The drill life test for evaluating machinablity was carried out using a 5 ϕ straight-shank drill made of SKH 51 as the tool until it became unable to be cut at a feed rate of 0.07 mm without using a lubricant. The results were evaluated by the cutting rate causing the cutting impossible at a cutting distance of 1,000 mm, and expressed as a ratio when the steel of Example 2 was defined 1.0.

TABLE 2-1

| No. | Hardness (HV) | Tensile characteristics: 0.2% Proof stress (MPa) | Tensile characteristics: Tensile strength (MPa) | Magentic permeability μ | Corrosion resistance: Pitting potential (V VS SCE) | Corrosion resistance: Ni elution ($\mu g/cm^2$) | Hot working Gleable test | Machinability Drill life test |
|---|---|---|---|---|---|---|---|---|
| Examples | | | | | | | | |
| 1 | 241 | 634 | 1051 | <1.01 | >1.1 | ≦0.1 | | |
| 2 | 264 | 652 | 1125 | <1.01 | >1.1 | ≦0.1 | Δ *1 | 1.0 |
| 3 | 298 | 721 | 1241 | <1.01 | >1.1 | ≦0.1 | | |
| 4 | 289 | 715 | 1224 | <1.01 | >1.1 | ≦0.1 | | |
| 5 | 267 | 653 | 1135 | <1.01 | >1.1 | ≦0.1 | | |
| 6 | 254 | 645 | 1121 | <1.01 | >1.1 | ≦0.1 | | |
| 7 | 261 | 651 | 1131 | <0.01 | >1.1 | ≦0.1 | | |
| 8 | 272 | 648 | 1152 | <0.01 | >1.1 | ≦0.1 | Δ *2 | |
| 9 | 280 | 638 | 1142 | <0.01 | >1.1 | ≦0.1 | | |
| 10 | 275 | 658 | 1151 | <0.01 | >1.1 | ≦0.1 | ○ *2 | |
| 11 | 281 | 653 | 1161 | <0.01 | >1.1 | ≦0.1 | ○ *2 | |
| 12 | 271 | 649 | 1148 | <0.01 | >1.1 | ≦0.1 | ○ *2 | |
| 13 | 286 | 651 | 1142 | <0.01 | >1.1 | ≦0.1 | ○ *2 | |
| 14 | 276 | 701 | 1189 | <0.01 | >1.1 | ≦0.1 | | |
| 15 | 274 | 671 | 1174 | <0.01 | >1.1 | ≦0.1 | | |
| 16 | 278 | 665 | 1171 | <0.01 | >1.1 | ≦0.1 | | |
| 17 | 269 | 664 | 1168 | <0.01 | >1.1 | ≦0.1 | | |

TABLE 2-1-continued

| No. | Hardness (HV) | Tensile characteristics 0.2% Proof stress (MPa) | Tensile characteristics Tensile strength (MPa) | Magentic permeability $\mu$ | Corrosion resistance Pitting potential (V VS SCE) | Corrosion resistance Ni elution ($\mu$g/cm$^2$) | Hot working Gleable test | Machinability Drill life test |
|---|---|---|---|---|---|---|---|---|
| 18 | 267 | 672 | 1173 | <0.01 | >1.1 | ≦0.1 | | |
| 19 | 265 | 666 | 1154 | <0.01 | >1.1 | ≦0.1 | | |
| 20 | 271 | 675 | 1166 | <0.01 | >1.1 | ≦0.1 | | |

Hot workability is ○ for base steel or more, Δ for about base steel and X for base steel or less. Example 2 is the base steel of *1 group and Example 8 is the base steel of *2 group.

TABLE 2-2

| No. | Hardness (HV) | Tensile characteristics 0.2% Proof stress (MPa) | Tensile characteristics Tensile strength (MPa) | Magentic permeability $\mu$ | Corrosion resistance Pitting potential (V VS SCE) | Corrosion resistance Ni elution ($\mu$g/cm$^2$) | Hot working Gleable test | Machinability Drill life test |
|---|---|---|---|---|---|---|---|---|
| Examples | | | | | | | | |
| 21 | 261 | 661 | 1162 | <1.01 | >1.1 | ≦0.1 | | |
| 22 | 263 | 663 | 1156 | <0.01 | >1.1 | ≦0.1 | | |
| 23 | 271 | 689 | 1201 | <1.01 | >1.1 | ≦0.1 | | |
| 24 | 254 | 648 | 1121 | <1.01 | >1.1 | ≦0.1 | ○ *1 | |
| 25 | 248 | 645 | 1119 | <1.01 | >1.1 | ≦0.1 | ○ *1 | |
| 26 | 253 | 651 | 1125 | <1.01 | >1.1 | ≦0.1 | ○ *1 | |
| 27 | 256 | 653 | 1116 | <1.01 | >1.1 | ≦0.1 | ○ *1 | |
| 28 | 248 | 648 | 1116 | <1.01 | 1.0 | ≦0.1 | | 1.3 |
| 29 | 254 | 634 | 1117 | <1.01 | 1.0 | ≦0.1 | | 1.2 |
| 30 | 256 | 647 | 1132 | <1.01 | 1.0 | ≦0.1 | | 1.5 |
| 31 | 261 | 648 | 1154 | <1.01 | 1.0 | ≦0.1 | | 1.2 |
| 32 | 251 | 648 | 1139 | <1.01 | 1.0 | ≦0.1 | | 1.2 |
| 33 | 263 | 651 | 1141 | <1.01 | 1.0 | ≦0.1 | | 1.2 |
| 34 | 259 | 642 | 1131 | <1.01 | 1.0 | ≦0.1 | | 1.2 |
| 35 | 251 | 643 | 1125 | <1.01 | >1.1 | ≦0.1 | | 1.1 |
| 36 | 243 | 651 | 1135 | <1.01 | 1.0 | ≦0.1 | | 1.2 |
| 37 | 261 | 653 | 1151 | <1.01 | >1.1 | ≦0.1 | | 1.2 |
| Comparative Examples | | | | | | | | |
| 1 | 185 | 361 | 625 | <1.01 | 0.41 | 1.2 | | |
| 2 | 265 | 610 | 1005 | <1.01 | 0.91 | ≦0.1 | | |
| 3 | 235 | 580 | 902 | <1.01 | 0.25 | ≦0.1 | | |

Hot workability is ○ for base steel or more, Δ for about base steel and X for base steel or less. Example 2 is the base steel of *1 group and Example 8 is the base steel of *2 group.
Machinability is a ratio when Example 2 is defined as 1.0.

As is evident from the results shown in Table 2, all samples of the invention which have a hardness of from 241 to 298 HV, a 0.2% proof stress of from 634 to 721 Mpa, a tensile strength of from 1051 to 1241 Mpa, a magnetic permeability of less than 1.01 $\mu$, a pitting potential of 1.0 or 1.1 V VS SCE and an Ni elution of 0.1 $\mu$g/cm$^2$ and contain one or two or more of Ca, Mg, B and REM were excellent in hot workability in comparison with the base steel which does not contain them, and the machinability of samples which contain a machinability improving element was 1.1 to 1.3 in comparison with Example 2 which does not contain the element.

Contrary to this, Comparative Example 1 which contains Ni and is equivalent to SUS 316 showed a hardness of 185 HV, a 0.2% proof stress of 361 Mpa and a tensile strength of 625 Mpa, which were considerably lower than those of the Examples, and its magnetic permeability was less than 1.01 similar to the case of Examples, but the pitting potential was considerably low and the Ni elution was 12 times or more in comparison with Examples.

Also, Comparative Example 2 whose Mn content is larger than Examples showed the similar degree of hardness, tensile strength, magnetic permeability and Ni elution in comparison with Examples, but its 0.2% proof stress was slightly lower and its pitting potential was also slightly lower.

In addition, Comparative Example 3 whose Mn content is larger than Examples showed the similar degree of magnetic permeability and Ni elution in comparison with Examples, but its hardness, 0.2% proof stress and tensile strength were slightly lower than those of Examples and its pitting potential was sharply low.

The high-strength, high corrosion-resistant and non-magnetic stainless steel of the invention exerts the following excellent effects due to its constitution.

(1) Though it does not use Ni, its corrosion resistance can be improved to a level equal to or higher than that of austenite stainless steel which contains Ni.
(2) Since it does not use Ni, it can be used as a material for living body use.
(3) Its hardness and tensile characteristics are markedly excellent in comparison with the conventional austenite stainless steel which contains Ni.

While the invention has been described in detail and with reference to specific embodiments thereof, it will be apparent to one skilled in the art that various changes and modifications can be made therein without departing from the scope thereof.

This application is based on Japanese patent application No. 2001-028196 filed Feb. 5, 2001, the entire contents thereof being hereby incorporated by reference.

What is claimed is:

1. A high-strength, high corrosion-resistant and non-magnetic stainless steel which comprises 0.15% or less of C, 1.0% or less of Si, 3.0 to 12.0% of Mn, 0.030% or less of P, 0.50% or less of Ni, 15.0 to 21.0% of Cr, 0.70 to 1.50% of N, 0.020% or less of A1 and 0.020% or less of 0, and further comprises one or two or more of 0.01 to 0.25% for each of Nb, Ti, V, Ta and Hf, a remainder of Fe and inevitable impurities.

2. A high-strength, high corrosion-resistant and non-magnetic stainless steel which comprises 0.15% or less of C, 1.0% or less of Si, 3.0 to 12.0% of Mn, 0.030% or less of P, 0.50% or less of Ni, 15.0 to 21.0% of Cr, 0.70 to 1.50% of N, 0.020% or less of A1 and 0.020% or less of 0, and further comprises one or two or more of 0.1 to 4.0% of Mo, 0.1 to 1.5% of Cu and 0.1 to 0.8% of W and one or two or more of 0.01 to 0.25% for each of Nb, Ti, V, Ta and Hf, a remainder of Fe and inevitable impurities.

3. The high-strength, high corrosion-resistant and non-magnetic stainless steel according to claim 1 or 2, wherein 0.0005 to 0.0100% for each of one or two or more of Ca, Mg, B and REM are contained instead of the same amount of a part of the remaining Fe.

4. The high-strength, high corrosion-resistant and non-magnetic stainless steel according to claim 1 or 2, wherein one or two or more of 0.03 to 0.04% of S, 0.005 to 0.05% of Te, 0.02 to 0.20% of Se and 0.0002 to 0.02% of Ca are contained instead of the same amount of a part of the remaining Fe.

5. The high-strength, high corrosion-resistant and non-magnetic stainless steel according to claim 3, wherein one or two or more of 0.03 to 0.4% of S, 0.005 to 0.05% of Te, 0.02 to 0.20% of Se and 0.0002 to 0.02% of Ca are contained instead of the same amount of a part of the remaining Fe.

* * * * *